United States Patent [19]

Garretson et al.

[11] Patent Number: 4,602,836

[45] Date of Patent: Jul. 29, 1986

[54] INSULATOR HOUSING WITH INTEGRALLY HINGED, SNAP-IN TERMINAL LOCK

[75] Inventors: Jay H. Garretson, Warren; Joseph H. Gladd; Emil J. Tolnar, Jr., both of Cortland, all of Ohio

[73] Assignee: General Motors Corporation, Detroit, Mich.

[21] Appl. No.: 610,825

[22] Filed: May 15, 1984

[51] Int. Cl.[4] ..... H01R 11/00

[52] U.S. Cl. ..... 339/59 R

[58] Field of Search ..... 339/59 R, 59 M, 220 R

[56] References Cited

U.S. PATENT DOCUMENTS

| | | | |
|---|---|---|---|
| 3,441,661 | 4/1969 | Brummans | 339/59 R |
| 3,781,760 | 12/1973 | Mancini et al. | 339/59 M |
| 3,990,759 | 11/1976 | Crowe | 339/59 R |
| 3,993,396 | 11/1976 | Eigenbrode | 339/220 R |
| 4,092,058 | 5/1978 | Eigenbrode | 339/220 R |

FOREIGN PATENT DOCUMENTS

| | | | |
|---|---|---|---|
| 0058237 | 10/1981 | European Pat. Off. . | |
| 1315693 | 5/1973 | United Kingdom | 339/59 M |

*Primary Examiner*—Gil Weidenfeld
*Assistant Examiner*—Gary F. Paumen
*Attorney, Agent, or Firm*—F. J. Fodale

[57] ABSTRACT

A molded insulator housing of thermoplastic material for an electrical terminal or terminals comprises a plurality of walls which define a corresponding number of elongated cavities having an opening at one end of the insulator housing for terminal insertion. The insulator housing has a terminal lock for each cavity integrally hinged to an outward flange on its bottom wall at the one end of the insulator housing and a slot for each cavity in the bottom wall which defines an inner surface for the terminal lock and flange portions which is substantially coplanar with an outer surface of the adjacent portions of the bottom wall to facilitate the molding of the terminal lock substantially free and separate of the material in the bottom wall. The terminal lock is movable from its molded position where it projects outwardly of the bottom wall and at least as much as the flange and a second retained position in which a portion of the terminal lock passes through the slot in the bottom wall and projects into the cavity to provide a terminal lock.

3 Claims, 6 Drawing Figures

INSULATOR HOUSING WITH INTEGRALLY HINGED, SNAP-IN TERMINAL LOCK

This invention relates to insulator housings and, more particularly, to insulator housings for one or more electrical terminals which have an integrally hinged, snap-in terminal lock for each terminal.

U.S. Pat. No. 3,441,661 issued to Wilhelmus J. Brummans on Apr. 29, 1969 discloses an insulator housing for an electrical terminal having a flap cut out from one wall of the insulator housing which is snapped into the insulator housing cavity to provide a terminal lock.

U.S. Pat. No. 3,990,759 issued to Terence A. Crowe on Nov. 9, 1976 discloses an insulator housing for an electrical terminal having a plurality of molded catches associated with a stepped wall of the insulator housing which are snapped into the insulator housing cavities to provide a pair of terminal locks. According to the Crowe specification, these catches can be formed in the molding process and do not require the separate slitting process which makes the cutout Brummans flaps uncompetitively expensive. Moreover, according to the Crowe specification, the catches project outwardly of the insulator wall by an amount at least twice the thickness of the wall to which they are attached, thereby providing improved terminal locking and greater versatility.

The Crowe insulator housing, however, has a major drawback in that it is difficult to mold because of the deep recess beneath the projecting portion of each catch, which in an interior "undercut" and thus restricts removal of the mold core. The adverse effect of the undercut on core removal is reduced by attaching the catch to the vertical part of a step in the housing wall and providing slots on either side of the catch which complicates the insulator housing shape. The housing shape moreover, introduces further complications in that exterior undercuts are produced by the catch portions which are inward of the step in the housing wall thus further complicating the molding process by the requirement for cross mold cores.

The object of this invention is to provide an insulator housing having an integrally hinged, snap-in terminal lock or locks which can be formed easily in a molding process.

One feature of the invention is that the insulator housing is shaped so that the terminal lock or locks are formed without interior undercuts which would restrict removal of the mold cores for forming the cavities in the insulator housing.

Another feature of the invention is that the insulator housing is shaped so that it does not have any exterior undercuts associated with the terminal lock or locks which complicate the molding process.

Yet another feature of the invention is that the terminal lock or locks may be shaped to improve the retention of the terminal locks in their locked position.

Other objects and features of the invention will become apparent to those skilled in the art as the disclosure is made in the following detailed description of a preferred embodiment of the invention as illustrated in the accompanying sheets of drawing in which.

Figure 1:
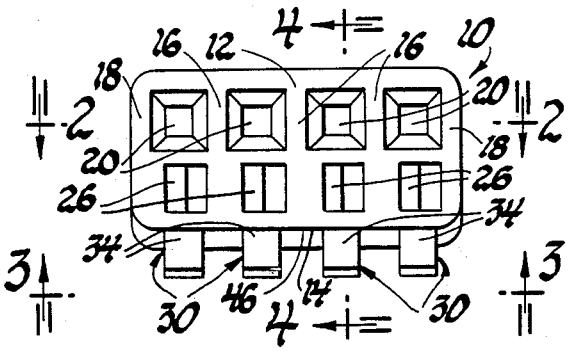
FIG. 1 is a front view of an insulator housing in accordance with our invention.
Figure 2:
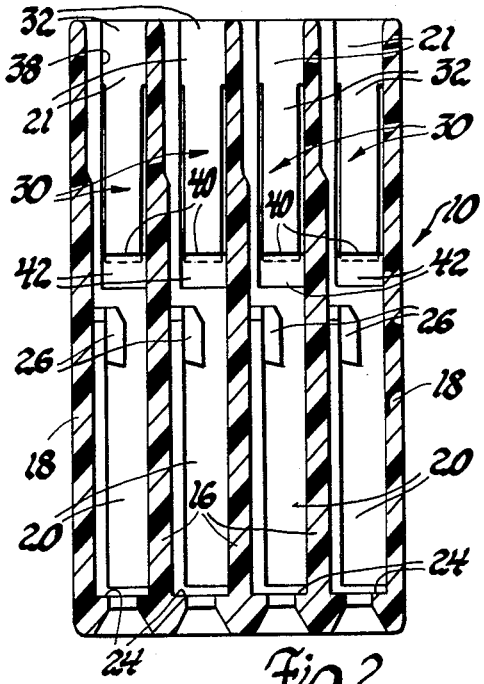
FIG. 2 is a transverse section taken substantially along the line 2—2 of FIG. 1.
Figure 3:
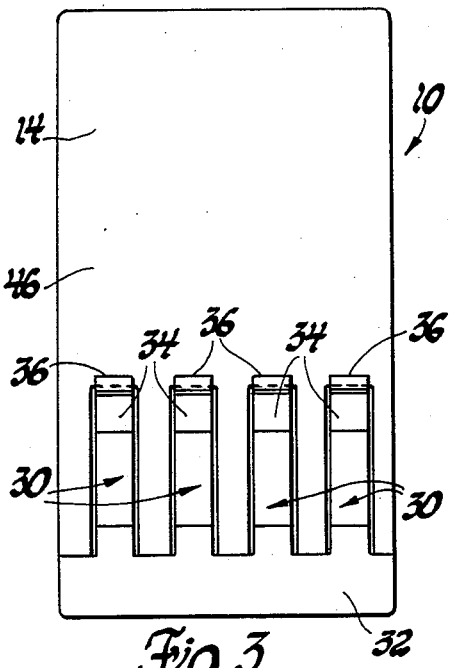
FIG. 3 is a bottom view of the insulator housing taken substantially along the line 3—3 of FIG. 1.
Figure 4:
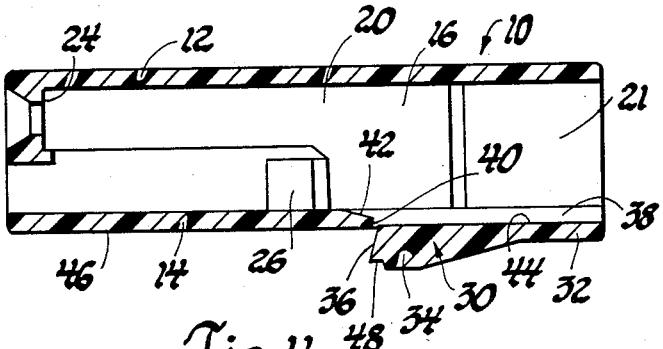
FIG. 4 is a longitudinal section taken substantially along the line 4—4 of FIG. 1.
Figure 6:
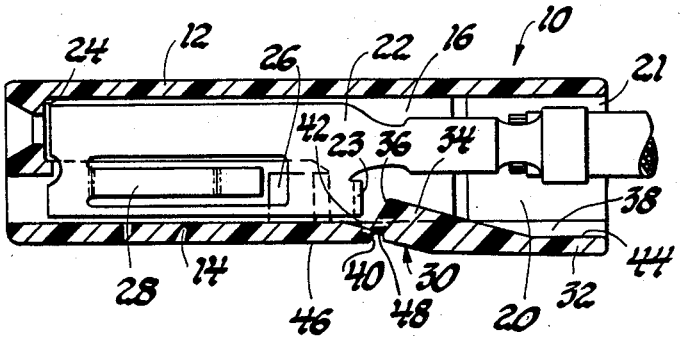
FIG. 6 is a longitudinal section similar to FIG. 4 showing the terminal lock retained in its locked position behind a lock tab of a terminal.

The drawing shows an insulator housing 10 which is made by a conventional molding process such as injection molding from a thermoplastic material, such as a polyester. The housing 10 comprises a top wall 12, a bottom wall 14 and a plurality of interior and exterior side walls 16,18 which define a plurality of elongated terminal cavities 20 of generally rectangular cross section. As best shown in FIGS. 2, 4 and 6, each elongated terminal cavity has an opening 21 at one end of the housing 10 for inserting a terminal 22 into the cavity and a stop shoulder 24 at the opposite end for arresting movement of the terminal upon full insertion into the cavity. Each cavity also has a medial projection 26 on one of its side walls 16 or 18 which cooperates with a latch tang 28 of the terminal 22 to lock the terminal 22 in the cavity 20. The terminal 22 is described in detail in pending U.S. patent application, Ser. No. 359,686, filed Mar. 19, 1982, now U.S. Pat. No. 4,448,477 issued May 15, 1984, and does not form a part of this invention, per se. It should be noted, however, that the terminal 22 includes a relatively rigid lock tab 23 which cooperates with the integrally hinged, snap-in terminal lock 30 to which this invention is directed.

The bottom wall 14 of the insulator housing 10 has an outward flange 32 at the end of the housing which has the openings 21 for insertion of the terminals 22 into the cavities 20. The outward flange 32 extends across the insulator housing 10 and each of the terminal locks 30 for the respective cavities 20 are connected to the flange 32 at one end. The opposite end of each terminal lock 30 has a projection 34 of generally trapezoidal cross-section which projects outwardly of the bottom wall 14 by a substantial amount. The projection 34 also projects outwardly of the flange 32 and the portion of the terminal lock 30 between the projection 34 and the flange 32 projects as much as the flange 32 so that the terminal lock 30 does not have an external undercut. The projection 34 terminates in an angled end face 36 at the free end of the terminal lock 30. The end face 36 forms an acute angle of about 80° with the outer surface of the bottom wall 14.

Each of the cavities 20 has a slot 38 in the bottom wall 14 which extends inwardly from the opening 21 at the end of the insulator housing to an angled edge 40 which is parallel to and slightly ahead about 0.10 mm, of the angled end face 36 of the associated terminal lock 30 as shown in FIG. 4. The slot 38 then flares into the inner surface of the bottom wall 14 to provide a shallow retainer ramp 42.

The portion of the slot 38 from the opening 21 up to the angled edge 40 has a depth which is substantially equal to the thickness of the bottom wall 14. This portion of the slot 38 is also as wide as the terminal lock 30 so that the terminal lock 30 and portions of the flange 32 are molded with an inner surface 44 which is substantially coplanar with the outer surface 46 of the bottom wall 14, particularly, those portions of the bottom wall 14 which are adjacent the sides and the end face 36 of the terminal lock 30. Consequently, the terminal lock 30 is molded substantially free and separate from the material of the bottom wall 14 and it is attached to the insulator housing 10 solely by the flange 32. The terminal lock 30 is thus formed entirely by the molding process and it is unnecessary to finish the terminal lock 30 by a separate cutting operation. Moreover, the terminal lock 30 does not produce any undercuts in the cavity 20 which resist withdrawal of the mold cores.

Figure 5:
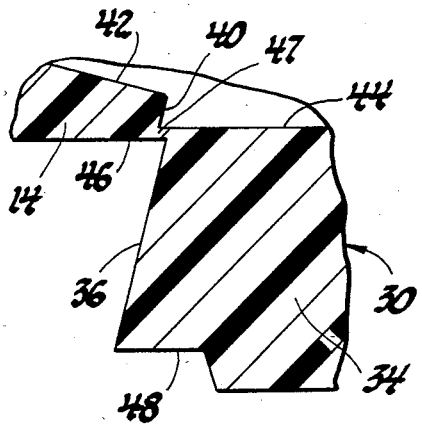
FIG. 5 is an enlargement of a portion of FIG. 4.

Due to the manufacturing tolerances, the inner surface 44 may end up inwardly of the outer surface 46 by a slight amount resulting in a thin web 47 connecting the terminal lock 30 to the bottom wall 14 as indicated in FIG. 5. The thickness of the web, however, is on the order of 0.20 mm. Consequently, the web is fractured easily so that for all practical purposes, the terminal lock 30 is molded substantially free and separate from the bottom wall 14 and for the purpose of this invention, the inner surface 44 and the outer surface 46 are substantially coplanar.

The terminal lock 30 has a small notch 48 in its outer surface adjacent the angled end face 36. When the terminal 22 is fully inserted in the cavity 20, as shown in FIG. 6, the projection 34 of the terminal latch 30 is pushed partway into the cavity 16 through the forward portion of the slot 38 to the position shown in FIG. 6 where angled end face 36 lies behind the lock tab 23 to prevent the terminal 22 from being pulled out of the cavity 20 through the opening 21. During this movement, the angled end face 36 snaps past the angled edge 40 of the slot 38 whereupon the terminal lock 30 is securely retained in the locked position of FIG. 6 by the engagement of the notch 48 with the shallow retainer ramp 42.

The terminal lock 30 is illustrated as being a secondary or redundant lock which operates in the event of failure of the primary terminal latch tang 28. However, the terminal lock 30 may be used as the primary or sole terminal lock.

We wish it to be understood that we do not desire to be limited to the exact details of construction shown and described, for obvious modifications will occur to a person skilled in the art.

The embodiments of the invention in which an exclusive property or privlege is claimed are defined as follows:

1. A molded insulator housing of thermoplastic material for an electrical terminal, comprising a plurality of walls which define an elongated terminal cavity having an opening at one end of the insulator housing for insertion of a terminal into the cavity, a stop shoulder in the cavity for arresting movement of a terminal inserted into the cavity, an outward flange on one wall of the housing defining the cavity, a terminal lock intergrally hinged to the flange at one end and having a end face at the opposite end, a slot in said one wall which extends from the one end of the housing to a position ahead of the end face of the terminal lock to define an inner surface for said terminal lock and flange portion which is substantially coplanar with an outer surface of adjacent portions of said one wall to facilitate the molding of the terminal lock substantially free and separate of the said one wall, said terminal lock being movable from its molded position outside of the insulator housing in which said end face projects outwardly of the other surface of said one wall and clear of the cavity to a second position in which a portion of the terminal lock passes through the slot in said one wall and projects into the cavity to prevent removal of a terminal in the cavity through the opening at the one end of the insulator housing, and a formation on the terminal lock which engages a formation adjacent an edge of the slot to retain the terminal lock in the second position.

2. A molded insulator housing of thermoplastic material for an electrical terminal, comprising a plurality of walls which define an elongated terminal cavity having an opening at one end of the insulator housing for insertion of a terminal into the cavity, a stop shoulder in the cavity for arresting movement of a terminal inserted into the cavity, an outward flange on one wall of the housing defining the cavity, a terminal lock integrally hinged to the flange at one end and having an angled end face at the opposite end, a slot in said one wall which extends from the one end of the housing to an angled edge ahead of the angled end face of the terminal lock to define an inner surface for said terminal lock and flange portion which is substantially coplanar with an outer surface of adjacent portions of said one wall to facilitate the molding of the terminal lock substantially free and separate of said one wall, said terminal lock being movable from its molded position outside of the insulator housing in which said terminal lock projects at least as much as the flange and outwardly of the outer surface of said one wall and clear of the cavity to a second position in which a portion of the terminal lock passes through the slot in said one wall and projects into the cavity to prevent removal of a terminal in the cavity through the opening at the one end of the insulator housing, and a formation on the terminal lock adjacent the angled end face which engages a formation adjacent the angled edge of the slot to retain the terminal lock in the second position.

3. The molded insulator housing as defined in claim 2 wherein the formation on the terminal lock is a notch in an outer surface adjacent the angled end face and the the formation adjacent the angled edge of the slot is a shallow retainer ramp in an inner surface of the said one wall, and wherein the the terminal lock is securely retained in the second position by engagement of the notch with the shallow retainer ramp.

* * * * *